United States Patent [19]

Weinand

[11] Patent Number: 4,978,074

[45] Date of Patent: Dec. 18, 1990

[54] SOLENOID ACTUATED VALVE ASSEMBLY

[75] Inventor: Louis H. Weinand, Troy, Mich.

[73] Assignee: General Motors Corporation, Detroit, Mich.

[21] Appl. No.: 369,508

[22] Filed: Jun. 21, 1989

[51] Int. Cl.[5] ..... F02M 51/00

[52] U.S. Cl. ..... 239/585; 251/129.18

[58] Field of Search ..... 239/585; 251/129.18

[56] References Cited

U.S. PATENT DOCUMENTS

| | | | |
|---|---|---|---|
| 4,082,067 | 4/1978 | Yanagihara | 239/533.9 X |
| 4,269,361 | 5/1981 | Seilly | 239/585 |
| 4,693,224 | 9/1987 | McKay | 123/531 |
| 4,759,335 | 7/1988 | Ragg et al. | 123/531 |
| 4,766,405 | 8/1988 | Daly et al. | 335/257 |
| 4,771,754 | 9/1988 | Reinke | 124/533 |
| 4,844,339 | 7/1989 | Sayer et al. | 239/585 X |

FOREIGN PATENT DOCUMENTS

| | | |
|---|---|---|
| 8600960 | 2/1986 | PCT Int'l Appl. . |
| 8807628 | 10/1988 | PCT Int'l Appl. . |

*Primary Examiner*—Andres Kashnikow
*Assistant Examiner*—William Grant
*Attorney, Agent, or Firm*—C. K. Veenstra

[57] ABSTRACT

An injector has a solenoid armature that displaces a valve from its seat to deliver a charge of fuel and air directly into the combustion chamber of a two-stroke cycle internal combustion engine. When a valve return spring closes the valve against its seat to terminate delivery of the fuel-air charge, the armature separates from the valve stem, and the kinetic energy of the aramture is dissipated by a resilient disk or ring. An adjustment is accessible at the end of the valve stem to establish the valve closing force of the return spring, an adjusting screw establishes the distance between the open and closed positions of the valve, and another adjusting screw positions the resilient disk.

9 Claims, 3 Drawing Sheets

SOLENOID ACTUATED VALVE ASSEMBLY

TECHNICAL FIELD

This invention relates to a solenoid actuated valve assembly suitable for use as an injector adapted to deliver a fuel-air charge directly into an engine combustion chamber.

BACKGROUND

U.S. Pat. No. 4,759,335 was issued 26 July 1988 in the names of P. W. Ragg, M. L. McKay and R. S. Brooks, and international patent application publication WO 86/00960 published 13 Feb. 1986 in the name of M. L. McKay, show embodiments of a injector that delivers a fuel-air charge directly into the combustion chamber of a two-stroke cycle engine. The injector has a valve that is opened by a solenoid to allow the fuel-air charge to be delivered into the combustion chamber, and that is closed against a seat by a spring to terminate delivery of the fuel-air charge.

Experience with injectors of that nature has revealed a tendency for the valve to bounce repeatedly onto and off its seat when the spring attempts to close the valve. As a result, the injector does not terminate delivery of the fuel-air charge as intended.

SUMMARY OF THE INVENTION

This invention provides a solenoid actuated valve assembly constructed to prevent bounce of the valve.

In a solenoid actuated valve assembly according to this invention, the solenoid armature and the valve are provided as separate elements. The armature may be biased by a light spring to engage the valve. This construction directly couples the armature and the valve as the valve is opened, but allows the armature to separate from the valve as the valve engages its seat. Thus with this construction, the valve-closing kinetic energy of the armature is not dissipated as the valve engages its seat, and valve bounce is prevented.

In a preferred embodiment of a solenoid actuated valve assembly according to this invention, a stop made from a resilient, high energy absorbing material such as Viton is provided to dissipate the kinetic energy of the armature. The stop is spaced from the armature under static conditions, and accordingly does not affect the closing force on the valve or suffer from creep or compression set.

The invention also provides a solenoid actuated valve assembly with readily accessible means for adjusting the force exerted by the valve closing spring, the travel of the valve between its closed and open positions, and the spacing between the armature and the stop.

The details as well as other features and advantages of two embodiments of an injector employing this invention are set forth in the remainder of the specification and are shown in the accompanying drawings.

THE PREFERRED EMBODIMENTS

Figure 1:
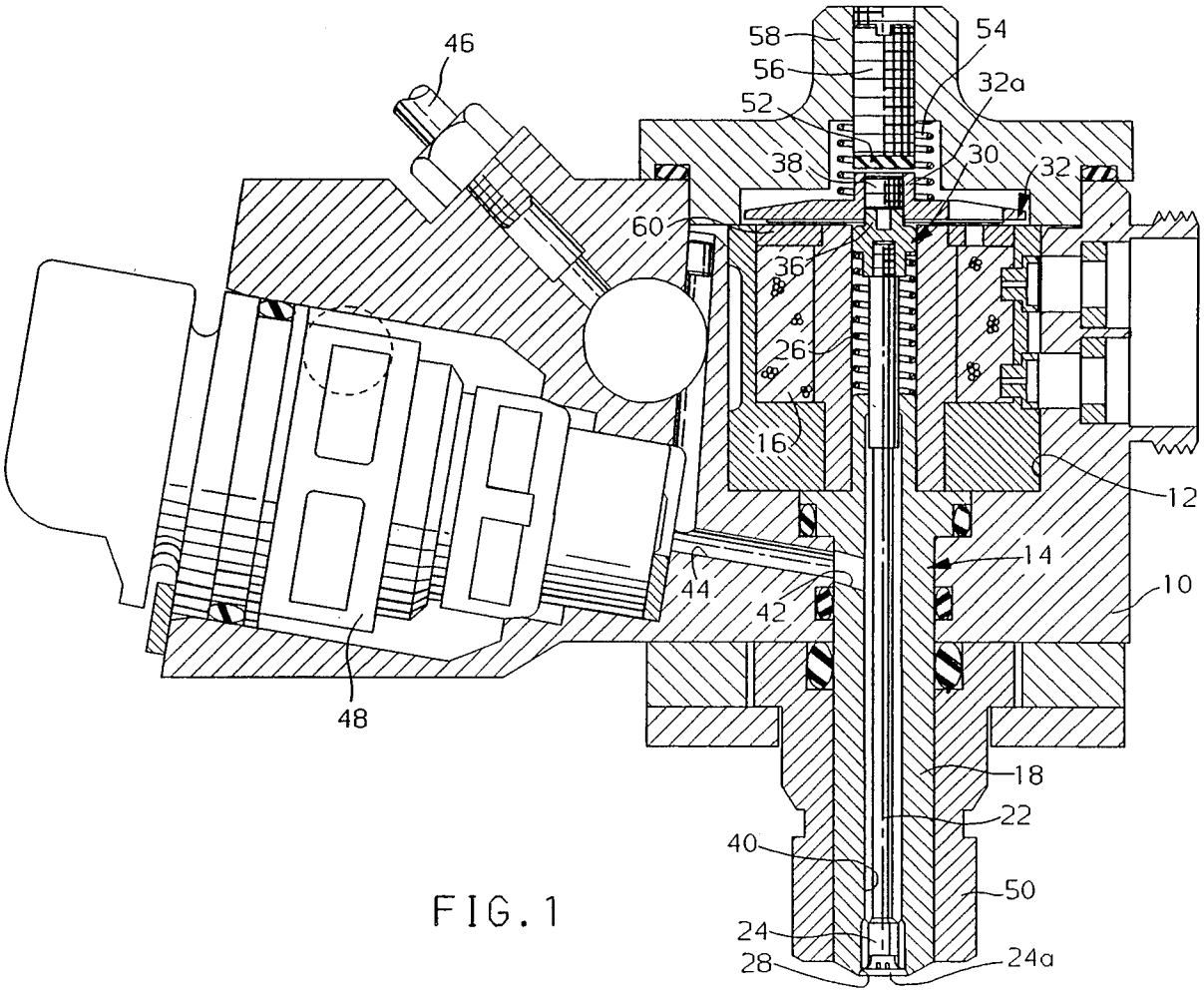
FIG. 1 is a sectional view of one embodiment of an injector employing this invention, having a resilient disk that dissipates the armature energy.
Figure 2:
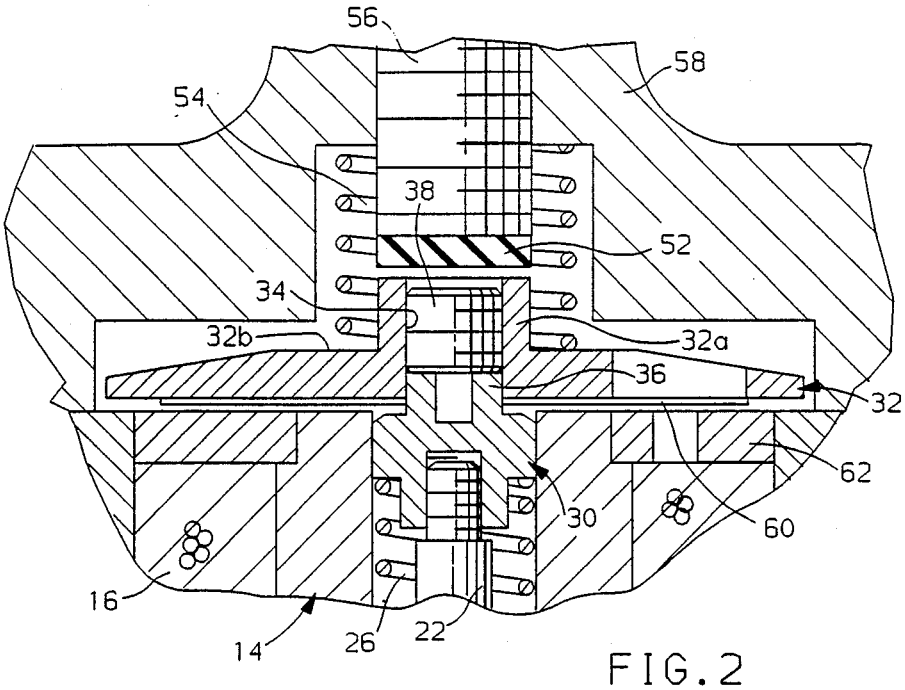
FIG. 2 is an enlarged view of a portion of FIG. 1, showing details of the top of the valve stem, the armature, the resilient disk, and the adjustments.

Referring first to FIGS. 1 and 2, an air-fuel rail body 10 has a stepped bore 12 receiving an injector 14 adapted to deliver a fuel-air charge directly into the combustion chamber of a two- stroke cycle engine (not shown). Injector 14 includes a solenoid coil 16 received in the upper portion of bore 12, and a nozzle 18 received in the lower portion of bore 12.

The upper portion of nozzle 18 acts as a guide for the stem 22 of a charge delivery valve 24. A valve return spring 26 biases valve 24 to engage its head **24*a* with a valve seat 28 on the lower end of nozzle 18. Spring 26 is seated against nozzle 18 and acts on a valve stem cap 30 threaded onto the upper end of stem 22. The position of cap 30 is adjusted on stem 22 to establish the valve closing force of spring 26**.

An armature 32 has a central bore 34 guided on the tip 36 of cap 30. An adjusting screw 38 is threaded into bore 34 for engagement with tip 36.

Nozzle 18 has a central bore 40 with a lateral aperture 42 that is aligned with a passage 44 in body 10. Passage 44 receives air from an inlet 46 and fuel from a fuel metering device 48.

Nozzle 18 is received in a holder 50 that is adapted to extend into the combustion chamber of the engine.

When coil 16 is energized, armature 32 is attracted downwardly and, acting through screw 38, cap 30 and stem 22, displaces valve head **24*a* from seat 28 against the bias of spring 26. Injector 14 thereby delivers a charge of fuel and air from passage 44 through bore 40** into the combustion chamber.

When coil 16 is de-energized, spring 26 lifts cap 30 and stem 22 to engage valve head **24*a* with seat 28, at the same time lifting armature 32. However, when valve head 24*a* engages seat 28, the inertia of armature 32 causes the adjusting screw 38 carried by armature 32 to separate from cap 30, and armature 32 continues upward. A projection 32*a* on armature 32 then engages a stop in the form of a resilient disk 52, and the kinetic energy of armature 32 is dissipated by disk 52**.

Armature 32 is guided at all times by the tip 36 of cap 30, and a light spring 54 biases armature 32 downwardly to re-engage adjusting screw 38 with the tip 36 of cap 30.

Because armature 32 continues its upward motion during the impact of valve 24 with seat 28, only the kinetic energy of valve 24 (including valve stem cap 30) must be dissipated during the impact of valve 24 with seat 28. That kinetic energy is dissipated without creating substantial bounce of valve 24.

Moreover, using disk 52 to dissipate the kinetic energy of armature 32 assures that armature 32 will not cause valve 24 to bounce as spring 54 re-engages the armature adjusting screw 38 with cap 30.

Disk 52 is secured on the end of an adjusting screw 56 that is mounted in the injector cover 58. Adjusting screw 56 is set to provide a slight clearance between armature 32 and disk 52 when the armature screw 38 engages cap 30. The resilience of disk 52 accordingly does not affect the valve closing force provided by spring 26, and disk 52 is not subject to the creep and compression set that might otherwise occur if armature 32 were to continually engage disk 52.

The bottom of armature 32 includes pads 60 that engage the top plate 62 of coil 16 when coil 16 is energized. Adjusting screw 38 provides a means for establishing the desired distance or gap between pads 60 and plate 62 when coil 16 is not energized, thereby establishing the travel of armature 32 and consequently establishing the travel of valve 24 between its closed and open positions.

Although the force of spring 54 opposes the force of spring 26, spring 54 is lighter than spring 26 and accordingly is not effective to open valve 24. Nevertheless, it will be appreciated that the valve closing force provided by spring 26 also could be calibrated by selecting an alternate spring 54 that is somewhat lighter or heavier than the original spring 54, or by providing an adjustment for the force exerted by spring 54.

Figure 3:
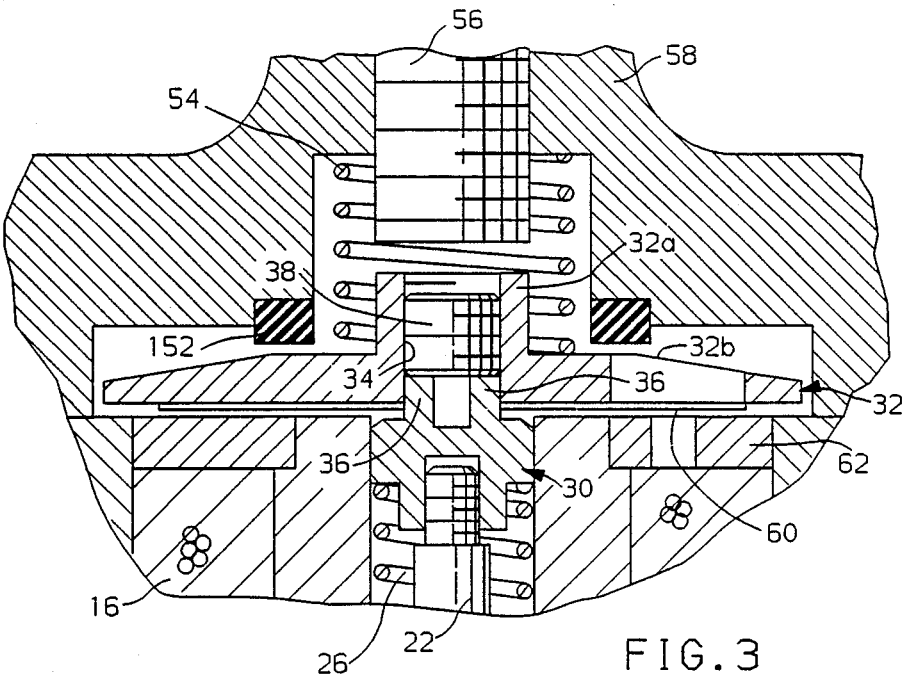
FIG. 3 is a view similar to FIG. 2, showing another embodiment in which a resilient ring dissipates the armature energy.

As shown in FIG. 3, disk 52 may be replaced by a ring 152 of resilient material. Ring 152 is engaged by an annular region **32*b* on armature 32 to dissipate the kinetic energy of armature 32 as armature 32 continues its upward movement after valve 24 engages seat 28**.

Although FIG. 2 shows the contacting surfaces of disk 52 and armature projection **32*a* to be flat and parallel, they may be contoured relative to one another to more gradually dissipate the kinetic energy of armature 32. For example, as shown in FIG. 3, a portion of the annular region 32*b* of armature 32 is at an angle to the ring 152 so the kinetic energy of armature 32** is dissipated gradually.

Figure 5A:
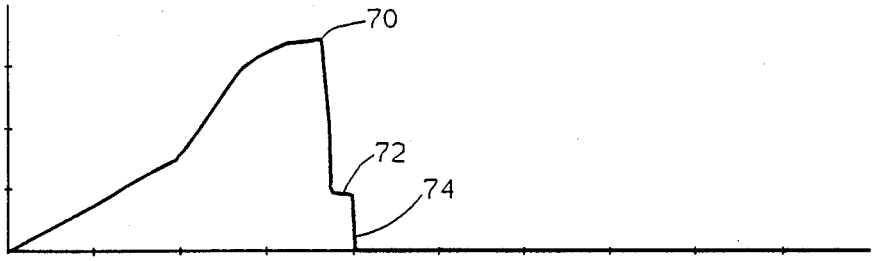
FIG. 5a PRIOR ART
FIGS. 5*a* and 5*b* illustrate the operation of the prior art injector.
Figure 5B:
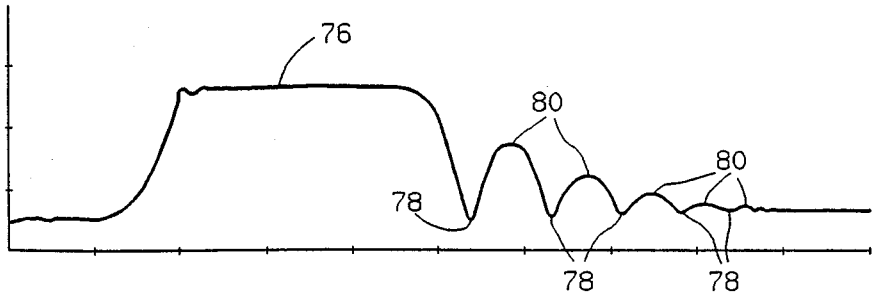
FIG. 5b PRIOR ART

The benefit provided by this invention is clear from a comparison of FIGS. **4*a* and 4*b* showing the operation of an injector employing this invention with FIGS. 5*a* and 5*b*** showing the operation of the prior art injector.

The current through the injector solenoid coils is shown along the vertical axes of FIGS. **4*a* and 5*a*, and time along the horizontal axes. For each injector, an 8 ampere peak current indicated at 70 was provided to open the valve, a 2 ampere holding current indicated at 72 was provided to hold the valve open, and the current was terminated at 74** to close the valve.

The position of the injector valves is shown along the vertical axes of FIGS. **4*b* and 5*b*, and time along the horizontal axes. Each injector valve reached its fully open position 76 a short time before its current reached the 8 ampere peak 70, and reached its closed position 78 a short time after its current was terminated at 74**.

Figure 4A:
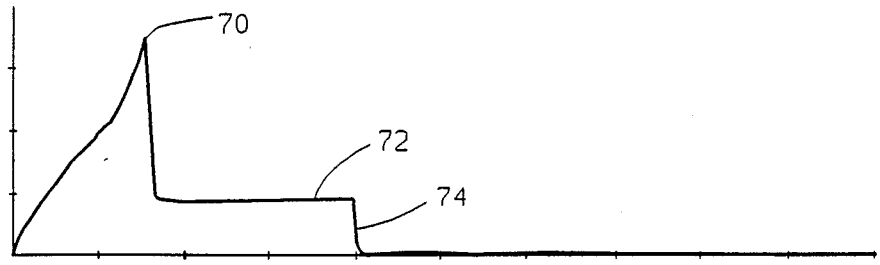
FIGS. 4*a* and 4*b* illustrate the operation of an injector employing this invention.
Figure 4B:
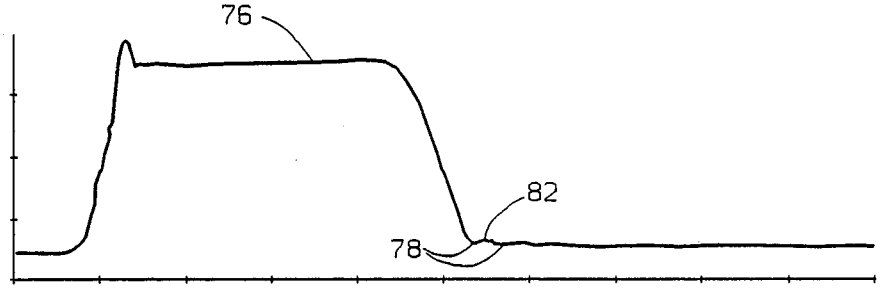

In this comparison, the injector represented in FIGS. **4*a* and 4*b* opened more rapidly than the injector represented in FIGS. 5*a* and 5*b*, and accordingly the current was reduced from the 8 ampere peak current to the 2 ampere holding current sooner for the injector represented in FIGS. 4*a* and 4*b* than for the injector represented in FIGS. 5*a* and 5*b***.

Despite the difference in the vertical scales of FIGS. **4*b* and 5*b***, the two injector valves actually opened the same distance. Moreover, it should be noted that the two valves also had nearly identical closing times.

As is clearly illustrated by the peaks 80, however, the valve in the prior art injector bounced open several times after initially closing. On the other hand, the valve in the injector employing this invention had only one, nearly imperceptible, bounce 82.

It will be appreciated that this invention may be employed in other applications as well as the fuel-air charge injectors depicted here.

I claim:

1. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, and wherein the armature separates from the valve as the valve engages the seat whereby the kinetic energy of the armature is not dissipated by engagement of the valve with the seat.

2. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, wherein the armature separates from the valve as the valve engages the seat whereby the kinetic energy of the armature is not dissipated by engagement of the valve with the seat, and wherein the armature is guided by contact with a portion of the valve.

3. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, wherein the armature separates from the valve as the valve engages the seat whereby the kinetic energy of the armature is not dissipated by engagement of the valve with the seat, the assembly further comprising a stop engaged by the armature after the armature separates from the valve, and wherein the stop includes a resilient disk engaged by the armature.

4. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, wherein the armature separates from the valve as the valve engages the seat whereby the kinetic energy of the armature is not dissipated by engagement of the valve with the seat, the assembly further comprising a stop engaged by the armature after the armature separates from the valve, and wherein the stop includes a resilient ring engaged by the armature.

5. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, wherein the armature separates from the valve as the valve engages the seat whereby the kinetic energy of the armature is not dissipated by engagement of the valve with the seat, and wherein the armature is biased to engage the valve.

6. A solenoid actuated valve assembly for controlling delivery of a fluid, the assembly comprising a valve seat, a valve engageable with the valve seat to terminate fluid delivery, a solenoid coil, an armature effective to displace the valve from the seat when the coil is energized, and a valve return spring effective to engage the valve with the seat when the coil is de-energized, wherein the armature separates from the valve as the valve engages the seat whereby the kinetic energy of the armature is not dissipated by engagement of the valve with the seat, and wherein the armature includes an adjusting screw that establishes the position of the armature relative to the valve and thereby establishes the distance between the closed and open positions of the valve.

7. A solenoid actuated valve assembly for controlling delivery of a fluid, the assembly comprising a valve seat, a valve including a valve head engageable with the valve seat to terminate fluid delivery, the valve further including a valve stem and a valve stem cap threaded onto the valve stem, an armature having a central bore guided on the tip of the cap, a spring biasing the armature to engage the cap, a solenoid coil, the armature being effective to displace the valve from the seat when the coil is energized, a valve return spring acting on the cap to engage the valve with the seat when the coil is de-energized, the position of the cap on the stem being adjustable to establish the force applied by the valve return spring to the valve, wherein the armature separates from the valve as the valve engages the seat whereby the kinetic energy of the armature is not dissipated by engagement of the valve with the seat, a resilient stop engaged by the armature after the armature separates from the valve, and an adjusting screw supporting the stop and establishing the distance between the stop and the armature, and wherein the armature has an adjusting screw that provides the engagement between the armature and the cap, the armature adjusting screw establishing the position of the armature relative to the valve and thereby establishing the distance between the closed and open positions of the valve.

8. An injector for delivering a charge to an engine, the injector comprising a valve seat, a valve including a valve head engageable with the valve seat to terminate delivery of the charge, the valve further including a valve stem and a valve stem cap threaded onto the valve stem, an armature having a central bore guided on the tip of the cap, a spring biasing the armature to engage the cap, a solenoid coil, the armature being effective to displace the valve from the seat when the coil is energized, a valve return spring acting on the cap to engage the valve with the seat when the coil is de-energized, the position of the cap on the stem being adjustable to establish the force applied by the valve return spring to the valve, wherein the armature separates from the valve as the valve engages the seat whereby the kinetic energy of the armature is not dissipated by engagement of the valve with the seat, and a resilient stop engaged by the armature after the armature separates from the valve, and wherein the armature has an adjusting screw that provides the engagement between the armature and the cap, the armature adjusting screw establishing the position of the armature relative to the valve and thereby establishing the distance between the closed and open positions of the valve.

9. An injector for delivering a charge of fuel and air directly into an engine combustion chamber, the injector comprising a nozzle receiving fuel and air, the nozzle having a valve seat through which fuel and air are delivered to the engine, a valve including a valve head engageable with the valve seat to terminate delivery of the fuel and air, the valve further including a valve stem and a valve stem cap threaded onto the valve stem, an armature having a central bore guided on the tip of the cap, a spring biasing the armature to engage the cap, a solenoid coil, the armature being effective to displace the valve from the seat when the coil is energized, a valve return spring acting on the cap to engage the valve with the seat when the coil is de-energized, the position of the cap on the stem being adjustable to establish the force applied by the valve return spring to the valve, wherein the armature separates from the valve as the valve engages the seat whereby the kinetic energy of the armature is not dissipated by engagement of the valve with the seat, and a resilient stop engaged by the armature after the armature separates from the valve, and wherein the armature has an adjusting screw that provides the engagement between the armature and the cap, the armature adjusting screw establishing the position of the armature relative to the valve and thereby establishing the distance between the closed and open positions of the valve.

* * * * *